United States Patent [19]

Herbert

[11] Patent Number: 4,544,347

[45] Date of Patent: Oct. 1, 1985

[54] ARTIFICIAL FUEL-EFFECT GAS FIRES

[75] Inventor: Eric D. Herbert, Warrington, England

[73] Assignee: Tennant Radiant Heat Limited, Warrington, England

[21] Appl. No.: 627,689

[22] Filed: Jul. 5, 1984

[30] Foreign Application Priority Data

Jul. 7, 1983 [GB] United Kingdom ..... 8318413

[51] Int. Cl.[4] ..... B32B 3/30

[52] U.S. Cl. ..... 431/125; 126/92 AC; 428/156; 428/167

[58] Field of Search ..... 428/156, 167; 431/125; 126/92 R, 92 AC; 52/596

[56] References Cited

U.S. PATENT DOCUMENTS 3,170,504 2/1965 Lanning ..... 126/92 R
3,947,229 3/1976 Richter ..... 431/125
4,276,869 7/1981 Kern ..... 431/125

FOREIGN PATENT DOCUMENTS 7811591 11/1978 Netherlands ..... 431/125

*Primary Examiner*—Paul J. Thibodeau
*Attorney, Agent, or Firm*—William R. Hinds

[57] ABSTRACT

A radiant fuel support for an artificial fuel-effect gas fire in the form of a plaque of refractory material having an upper surface formed with a series of ridges with channels therebetween, the ridges being designed to support artificial fuel elements placed thereon and the channels being designed to receive gas flames impinging on the surface thereof; the support being mounted in an artificial fuel-effect gas fire having a series of flame producing means, with each such means being arranged so that a flame therefrom would impinge on the surface of one of the channels at a shallow, glancing angle thereto, the artifical fuel elements being arranged on the ridges to bridge the channels; by this means the channels and the undersurfaces of the fuel elements can be heated by the flames which would also appear as naked flames above the support and between the fuel elements.

20 Claims, 3 Drawing Figures

ARTIFICIAL FUEL-EFFECT GAS FIRES

This invention relates to artificial fuel-effect gas fires and to a radiant support for the fuel elements for such fires.

In accordance with the present invention, a radiant fuel support for an artificial fuel-effect gas fire is in the form of a plaque of refractory mateial having an upper surface and a lower surface, the upper surface being formed with a series of ridges with closed-bottom channels therebetween, the ridges being designed to support artificial fuel elements placed thereon so as to bridge the channels and the channels being open-ended at least at one end and designed to receive gas flames playing directly onto the upper surface thereof at a shallow glancing angle thereto, the plaque being devoid of flame or fuel passages extending therethrough between its upper and lower surfaces.

The fuel support preferably is formed of a lightweight ceramic material, such as a fired ceramic foam.

Also in accordance with the invention, there is provided, in combination for forming an artificial fuel-effect gas fire, a radiant fuel support as described above, and flame producing means for producing a series of flames arranged so that each flame therefrom would play directly onto the upper surface of a respective one of the channels at a shallow glancing angle thereto. Artificial fuel elements may be arranged on the ridges to bridge the channels, so that the channels and the under surfaces of the fuel elements can be heated by the flame when produced which would also appear as naked flames above the support and between the fuel elements, combining to give a reasonably realistic effect of partially unburnt fuel lying on a bed of glowing embers and ashes. Preferably the fuel support is inclined at an acute angle to the horizontal so as to have upper and lower edges between which the ridges and channels run, and the flame producing means is or are located adjacent the lower edge, the lower edge being the front edge in use.

Also in accordance with the invention, there is provided, in combination for forming an artificial fuel-effect gas fire, a radiant fuel support in the form of a plaque of refractory material having an upper surface and a lower surface, the upper surface being formed with a series of ridges with channels therebetween, the ridges being designed to support artificial fuel elements placed thereon so as to bridge the channels, and the channels being designed to receive gas flames impinging on the surface thereof, and flame producing means for producing a series of flames arranged so that each flame therefrom would play directly onto the upper surface of a respective one of the channels at a shallow glancing angle thereto.

The artificial fuel elements may be secured in various manners, and the undersides of at least some of the fuel elements can extend part-way down into the channels.

The ridges and channels may be in a regular, rectilinear array running parallel to one another, the ridges and channels may be irregular with crossbranches linking the channels or the ridges may be an irregular array of elongate protrusions, leaving a similar irregular array of indentations therebetween to form the channels.

The above and other features of the present invention are illustrated, by way of example, in the drawings wherein:

FIG. 3 is a section of an artificial fuel-effect gas fire in accordance with the invention.

Figure 1:
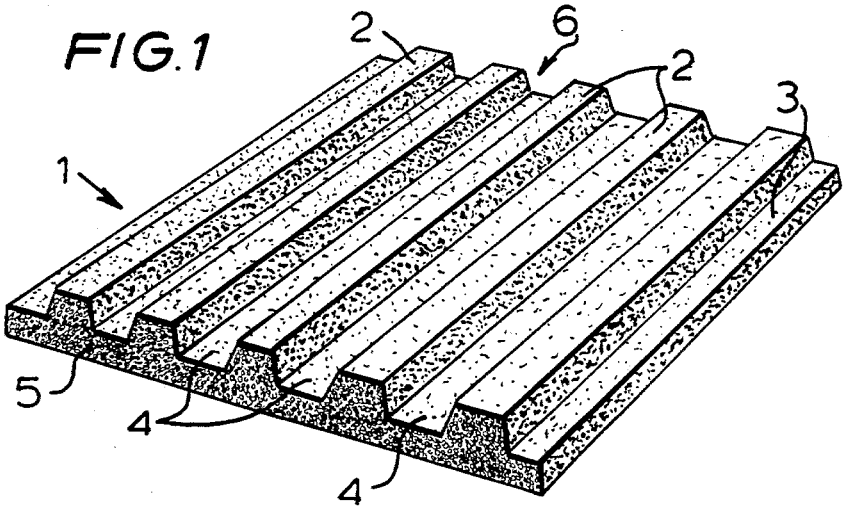
FIG. 1 is a perspective view of one embodiment of a radiant support in accordance with the invention.

FIG. 1 shows a radiant support in the form of a rectilinear plaque 1 having a parallel series of ridges 2 in the upper surface 3 thereof, forming a parallel series of channels 4 therebetween, both running from the front edge 5 to the rear edge 6 of the plaque. The ridges 2 and channels 4 are straight, equi-spaced and of rectangular cross-section. In practice, the plaque can be of any desired shape as can the channels and ridges and the cross-sections and spacing can be as required to give a desired effect.

In an un-illustrated embodiment, the ridges and channels can be irregular or non-linear rather than straight and the channels can be joined, one to another, with cross-linking branches.

Figure 2:
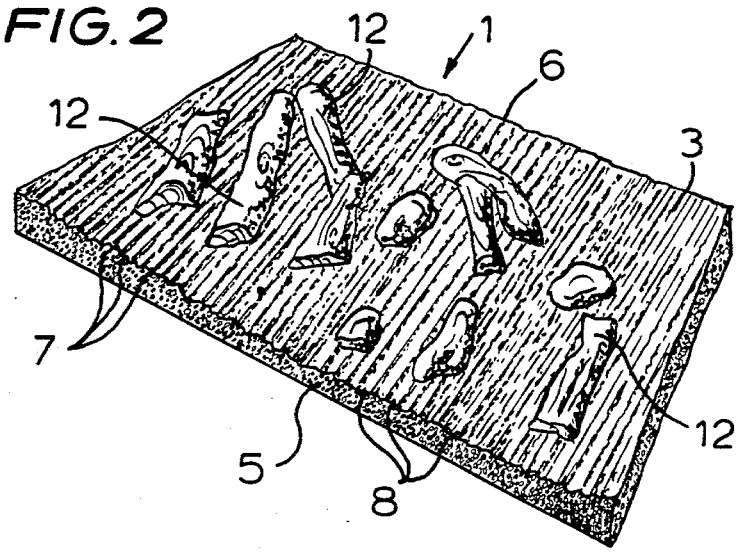
FIG. 2 is a similar view of another embodiment of a radiant support.

FIG. 2 shows another embodiment wherein the plaque 1 is of a trapezoidal shape having, in the upper surface 3 thereof, an irregular array of elongate protrusions 7, which protrusions are shown to be generally aligned with one another and with each running partway between the front and rear edges 5 and 6 of the plaque. The protrusions 7 leave shallow or deep indentations 8 therebetween which form the necessary flame channels in the support.

The plaque is made from a lightweight ceramic material sufficiently refractory to withstand service temperatures, ranging between 800 and 12000 degrees centigrade, without distortion, shrinkage or thermal stress damage. A most convenient material being a fired ceramic foam.

The plaque can be pre-shaped by forming the ridges, channels, projections and/or indentations either in a precursor material or in the green state, then firing to a temperature appropriate to the particular ceramic composition to achieve the required final properties.

Alternatively, the upper surface shape could be formed by affixing strips of appropriate shape onto a flat plaque.

Another method could be to machine the surface of the fired plaque to give the required configuration.

The plaque can be made from any composition having good reflective and radiative properties. For example, one suitable composition is thought to be 90% Alumina, 7.5% Silica, 1.5% Combined Alkalis, 0.5% Iron Oxide and 0.5% Titania.

Additionally, the plaque may be coloured either by coating it with a ceramic surface colourant (a glaze or engobe) or by incorporating a colouring agent in the body formation.

The foam can be of a pore size, from 10 pores to the inch to 60 pores to the inch, though 30 pores to the inch is preferred. A possible precursor is polyurethane foam.

The gas fire 9 shown by FIG. 3 consists of a radiant support 1, as any described above, mounted at an angle above a bank of gas jets 10, which may be either aerated or neat burning, with each jet arranged so that the flame (11) therefrom is directed up a channel to impinge at a very shallow or glancing angle with the bottom of the channel. Alternatively, a multi-ported gas burner could be used with each port aligned below a channel of the support.

Artificial fuel elements 12 in the form of ceramic or ceramic fibre coal, coke, logs or the like, are arranged (as indicated in FIG. 2) and either loosely or by bonding to rest on the support ridges or projections to bridge the channels or indentations and possibly extend slightly down into the channels. The elements and support could be shaped so as to key with one another.

The flames impinging on the channel surfaces and the undersurfaces of the fuel-elements raise the temperature thereof until they are incandescent; additionally, flames will appear between the fuel elements.

I claim:

1. A radiant fuel support for an artificial fuel-effect gas fire and in the form of a plaque of refractory material having an upper surface and a lower surface, the upper surface being formed with a series of ridges with closed-bottom channels therebetween, the ridges being designed to support artificial fuel elements placed thereon so as to bridge the channels and the channels being open-ended at least at one end and designed to receive gas flames playing directly onto the upper surface thereof at a shallow glancing angle thereto, said plaque being devoid of flame or fuel passages extending therethrough between its upper and lower surfaces.

2. A fuel support as claimed in claim 1, wherein the plaque is generally rectilinear and the ridges run generally parallel to one another from one edge of the plaque to an opposed edge thereof.

3. A fuel support as claimed in claim 2, wherein the ridges are straight, equi-spaced and of rectangular cross-section.

4. A fuel support as claimed in claim 3 and formed of a lightweight ceramic material.

5. A fuel support as claimed in claim 4, wherein the ceramic material is a fired ceramic foam.

6. A fuel support as claimed in claim 1, wherein the ridges are non-linear and the channels therebetween are linked one to the other by cross-branches.

7. A fuel support as claimed in claim 6 and formed of a lightweight ceramic material.

8. A fuel support as claimed in claim 7, wherein the ceramic material is a fired ceramic foam.

9. A fuel support as claimed in claim 1, wherein the plaque is of trapezoidal shape and the ridges are formed as an array of elongate protrusions in the plaque upper surface, said protrusions being generally aligned with one another and each running partway between the front and rear edges of the plaque.

10. A fuel support as claimed in claim 9 and formed of a lightweight ceramic material.

11. A fuel support as claimed in claim 10, wherein the plaque is coloured.

12. In combination for forming an artificial fuel-effect gas fire, a radiant fuel support as claimed in claim 1, and flame producing means for producing a series of flames arranged so that each flame therefrom would play directly onto the upper surface of a respective one of the channels at a shallow, glancing angle thereto.

13. Apparatus as claimed in claim 1, wherein the shapes of the fuel elements and the shapes of the ridges and channels are such that the undersides of at least some of the fuel elements can extend part-way down into the channels.

14. Apparatus as claimed in claim 1, wherein the fuel elements are bonded to the support ridges.

15. Apparatus as claimed in claim 1, wherein at least some of the fuel elements are shaped to key with the ridges and channels of the support upper surface.

16. Apparatus as claimed in claim 12, wherein said flame producing means is a series of gas jets, each jet being arranged to direct a flame up one of the channels.

17. Apparatus as claimed in claim 12, wherein said flame producing means is a multi-ported gas burner, each port being aligned with one of the channels.

18. Apparatus as claimed in claim 12 further comprising artificial fuel elements arranged on said ridges to bridge the channels, so that the channels and the under surfaces of the fuel elements can be heated by the flames when produced which would also appear as naked flames above the support and between the fuel elements.

19. Apparatus as claimed in claim 12 wherein the fuel support is inclined at an acute angle to the horizontal so as to have upper and lower edges between which said ridges and channels run, and said flame producing means is located adjacent the lower edge, the lower edge being the front edge in use.

20. In combination for forming an artificial fuel-effect gas fire, a radiant fuel support in the form of a plaque of refractory material having an upper surface and a lower surface, the upper surface being formed with a series of ridges with channels therebetween, the ridges being designed to support artificial fuel elements placed thereon so as to bridge the channels and the channels being designed to receive gas flames impinging on the surface thereof, and flame producing means for producing a series of flames arranged so that each flame therefrom would play directly onto the upper surface of a respective one of the channels at a shallow glancing angle thereto.

* * * * *